United States Patent [19]

Bongartz et al.

[11] Patent Number: 4,922,592

[45] Date of Patent: May 8, 1990

[54] METHOD FOR CONTROLLING THE AMOUNT OF SIZE APPLIED TO A TRAVELING TEXTILE SUBSTRATE

[75] Inventors: Heinrich Bongartz, Monchen-Gladbach; Peter Ruch, Schwalmtal; Gerhard Voswinckel, Aachen, all of Fed. Rep. of Germany

[73] Assignee: Gebrueder Sucker & Franz Mueller GmbH & Co., Monchen-Gladbach, Fed. Rep. of Germany

[21] Appl. No.: 228,604

[22] Filed: Aug. 4, 1988

[30] Foreign Application Priority Data

Aug. 5, 1987 [DE] Fed. Rep. of Germany ..... 3725890

[51] Int. Cl.[5] ..... D06B 3/04

[52] U.S. Cl. ..... 28/183; 68/22 R; 364/470

[58] Field of Search ..... 28/182, 183; 68/22 R; 364/470

[56] References Cited

U.S. PATENT DOCUMENTS

| | | | |
|---|---|---|---|
| 2,794,236 | 6/1957 | Griffin | 28/183 |
| 2,976,600 | 3/1961 | Edgar | 28/183 X |
| 2,992,626 | 7/1961 | Kabelitz | 28/183 X |
| 3,120,050 | 2/1964 | Cocker, III | 28/183 |
| 3,253,315 | 5/1966 | Eicken | 28/183 |
| 4,793,035 | 12/1988 | Nehrenberg et al. | 28/183 |

FOREIGN PATENT DOCUMENTS

| | | | |
|---|---|---|---|
| 1460320 | 11/1968 | Fed. Rep. of Germany | 28/183 |
| 1460388 | 1/1970 | Fed. Rep. of Germany | 68/22 R |
| 2613446 | 10/1977 | Fed. Rep. of Germany | 28/183 |
| 48-1473 | 1/1973 | Japan | 28/183 |
| 1094710 | 12/1967 | United Kingdom | 28/183 |

*Primary Examiner*—Werner H. Schroeder
*Assistant Examiner*—Bradley K. DeSandro
*Attorney, Agent, or Firm*—Shefte, Pinckney & Sawyer

[57] ABSTRACT

In a size applicator in which size is circulated between a reservoir tank and an applicator tank from which the size overflows back into the reservoir tank, the squeezing pressure applied to the traveling textile substrate is regulated in response to a sensing of the speed of the substrate. A secondary regulation is applied as a function of sensing of the volume of the size being in comparison with the substrate speed. This sensing of the volume of the size being consumed is accomplished by a hydrostatic sensor in the reservoir tank, the output of which sensing is applied to a microprocessor that compares the signal from the size level sensor with the signal from the tachometer that senses the substrate speed, and upon the comparison exceeding a predetermined tolerance, a further regulation is applied to the piston-cylinder mechanisms that control the squeezing pressure between squeeze rollers and between an emersion roller and the bottom squeeze roller.

2 Claims, 1 Drawing Sheet

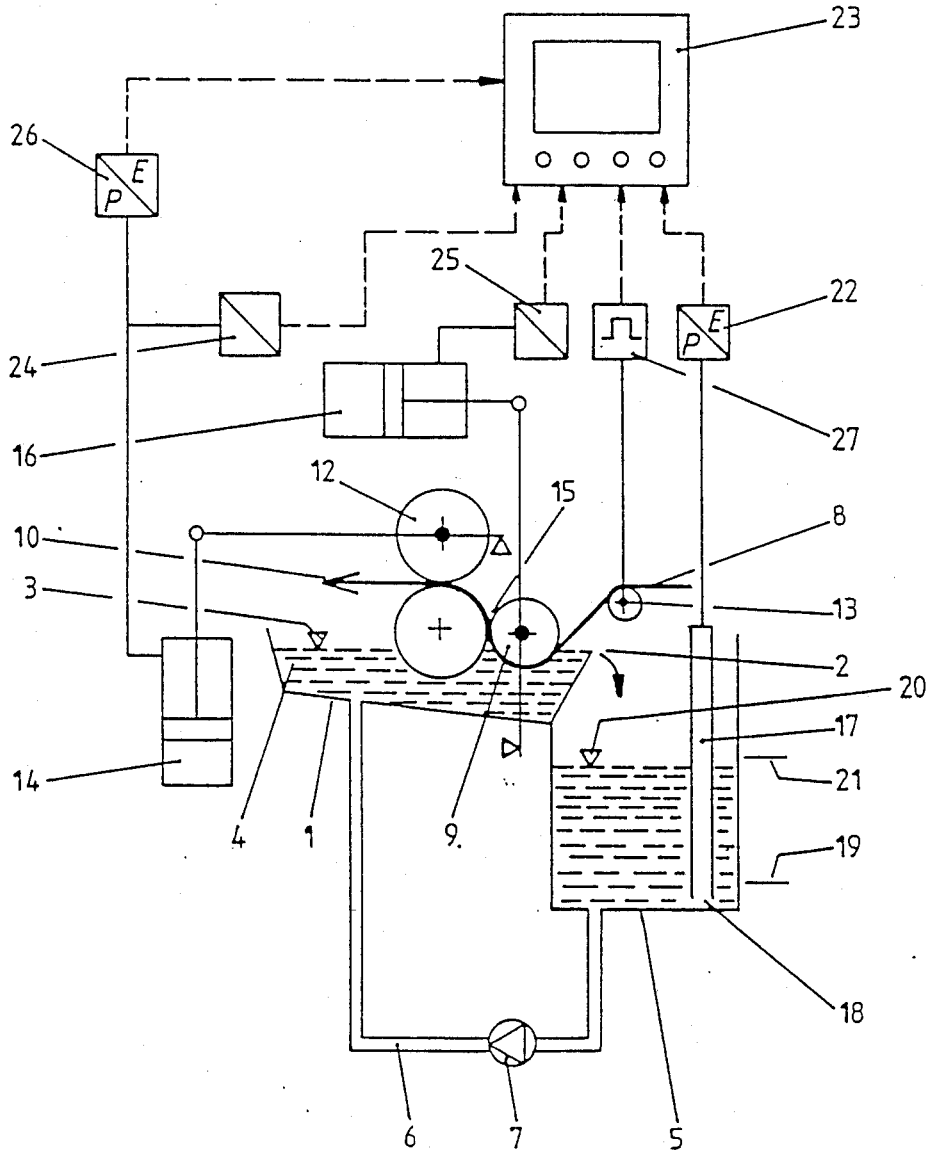
23
26
E
P
25
22
E
P
24
27
16
12
15
8
10
3
13
2
20
17
14
21
4
1
9
19
18
6
7
5

METHOD FOR CONTROLLING THE AMOUNT OF SIZE APPLIED TO A TRAVELING TEXTILE SUBSTRATE

BACKGROUND OF THE INVENTION

The present invention relates to a method and means for controlling the amount of size applied to a traveling textile substrate, and more particularly to such a method and means in which the size is applied to a traveling textile substrate in a size applicator in which the substrate is passed through a size bath and squeeze rollers with the squeezing pressure being regulated as a function of the speed of the substrate.

In industrial use of size applicators it is the intended purpose to apply a uniform optimum amount of sizing to the textile substrate, such as yarn, independent of the speed of travel of the textile substrate. The amount of sizing applied is conventionally controlled by regulating the squeezing pressure of the squeezing unit. When the speed of the traveling textile substrate is changed i.e. from normal running speed to a slow speed, the regulating device changes the squeezing pressure. To maintain a constant size pick-up, a high squeezing pressure is applied when the traveling textile substrate, such as a sheet of warp yarns, is traveling at normal operating high speed, and a relatively low squeezing pressure is applied when the speed of the traveling substrate is reduced. This control of the squeezing pressure as a function of the speed of travel, does not necessarily result in a uniform pick-up. Attempts have been made to enhance control by taking actual measurements of the substrate through infra-red, micro-wave or beta-ray devices. However, despite the substantial expense of such sophisticated devices, acceptable reliability of results has not been obtained. Rather, at the present time the uniformity of size application depends largely on the ability and experience of the operators.

SUMMARY OF THE INVENTION

The purpose of the present invention is to provide automatic control of the squeezing pressure of the squeeze roll unit of a size applicator to obtain acceptable uniform size pick-up by the traveling substrate. This is accomplished by regulating the squeezing pressure in response to depletion of size from the size bath in combination with the conventional control in response to the speed of travel of the substrate.

According to the present invention, the amount of size pick-up by the substrate is determined solely by measurement of the volume of the sizing consumed from the applicator. This measuring method, which is indirect per se, provides clear and reproducible information regarding the actual amount of size picked up. None of the expensive prior art devices of the type mentioned above is required for this indirect measurement. All that is needed is a conventional level sensing device that determines the volume of the size in the bath or in a reservoir tank from which size is circulated to and from the size bath. It is generally preferred to keep the level of size constant in the size bath itself and to sense the level of the size in the reservoir tank, which can be sensed by a level indicator such as a pressure gauge.

The present invention is based on the recognition that the size picked up from the size applicator can be determined indirectly but as precisely as required by measuring the consumption of the size from the size applicator.

Briefly described, the method of the present invention is a method for controlling the amount of size applied to a traveling textile substrate in a size applicator in which the substrate is passed through a size bath and squeeze rollers, the squeezing pressure of which is regulated as a function of the speed of the substrate. The present invention adds to the conventional regulation as a function of the speed of the substrate a sensing of the volume of size being consumed and regulating the squeezing pressure as an additional function of the sensing of the size consumed. In the preferred embodiment of the method of the present invention the sensing of the volume of size consumed is compared with the speed of the substrate and the regulating is further performed is response to variants of the comparison from a predetermined tolerance.

The means of the present invention includes means for sensing the volume of size being consumed and means for further regulating the squeezing pressure of the squeezing rollers as a function of volume of the the size consumed as sensed by the sensing means, which regulation is in addition to the regulation as a function of the speed of the substrate. Preferably, means are included for comparing the volume of size consumed as sensed by the sensing means with the speed of the substrate and the means for further regulating the squeezing pressure is responsive to the comparison to perform the further regulating of the squeezing pressure upon variants of the comparison from a predetermined tolerance.

In a typical conventional size applicator, the application of size is carried out with a constant size level in an applicator tank, which constant level is obtained by allowing excess size to overflow from the applicator tank into a reservoir tank during circulation of size between the tanks using a circulation pump. Thus, a portion of the circulating size overflows from the applicator tank to the reservoir tank while a portion of the size is picked up and carried away by the substrate. As a result, the volume of the size in the reservoir tank decreases in proportion to the size picked up by the substrate. In the preferred embodiment of the means of the present invention, the means for sensing the volume of size being consumed is means for sensing a depletion of size from the reservoir tank and this depletion is used as a variable for regulating the squeezing pressure in combination with the regulating as a function of the speed of the substrate.

The further regulating of squeeze pressure as a function of depletion of size from the reservoir tank is preferably used only for periodic correction, i.e., subordinate to the squeezing pressure regulation as a function of substrate speed. It is also preferable in practical operation to effect the corection of the squeezing pressure only when a value varies from a tolerance value of the comparison of the depletion of size and substrate speed. Therefore, in normal operation, the sensing and correction, if necessary, is accomplished periodically rather than continuously.

Other and further features and advantages of the present invention will be apparent from the accompanying drawing and following detailed description of the preferred embodiment.

BRIEF DESCRIPTION OF THE DRAWING

The accompanying drawing is a schematic illustration of a size applicator in which the preferred embodiment of the present invention is incorporated.

DETAILED DESCRIPTION OF THE PREFERRED EMBODIMENT

A size applicator of the overflow circulation type is illustrated in the accompanying drawing. The applicator includes a tank or trough I containing liquid size 4 that overflows over an edge 2 into a reservoir tank 5 therebelow. The size 4 is returned from the reservoir tank 5 through a feed pipe 6 to the applicator tank 1 by a circulating pump 7 that is located in the feed pipe 6. A traveling textile substrate 8 in the form of a sheet of warp yarns to be sized runs over an emersion roll 9 partially in the size bath 4 in the direction of the arrow 10 and, after immersed from the size bath 4, it passes between the nip of a pair of squeeze rollers 12. The speed of travel of the substrate 8 is monitored using a tachometer 13 located in advance of the emersion roller 9.

The squeezing pressure in the nip of the pair of squeeze rolls 12 is adjustable by means of a piston-cylinder mechanism 14. In addition, a squeezing pressure is applied in the nip 15 between the emersion roller 9 and the bottom roller of the pair of squeeze rollers 12, which squeezing pressure is controlled by a piston-cylinder mechanism 16.

The amount of size in the reservoir tank 5 is sensed by sensing means in the form of a level indicator 17 emersed with its end deep enough in the reservoir tank 5 so that its orifice remains below the minimum size level 19 expected during normal operation of the size applicator. When the level 29 of size in the reservoir tank 5 decreases to the minimum level 19, additional size is added to the reservoir tank 5 from a source not illustrated to fill the reservoir tank 5 to a maximum level 21. The height of the size in the reservoir tank 5 above the orifice 18 of the level indicator 17 produces a hydrostatic pressure that is sensed by a pneumatic-electric transducer 22 and transmitted in the illustrated embodiment to a control device 23, such as a microprocessor.

In operation, the squeezing pressure responsive to the speed of travel of the substrate 8 is adjusted and precisely regulated as a base pressure adjustment at the nip of the squeeze rollers 12 and the nip 15 between the emersion roller 9 and the lower squeeze roller 12. The squeezing pressure thus regulated is further automatically regulated as a function of the sensing by the level indicator 17 of the reduction of the volume of size from the reservoir tank 5, which pressure regulation is applied when a predetermined variant in the pick-up of size is determined. Thus, the additional squeezing pressure regulation as function of the volume of the size being consumed is subordinate to the primary regulation as a function of the speed of the substrate.

In the primary regulation as a function of the speed of the substrate, which speed is sensed by the tachometer 13, a greater speed automatically results in an increase of the squeezing pressure in the nip of the squeeze rollers 12 and the nip 15 between the emersion roller 9 and the lower squeeze roller 12. Conversely, a decrease of the squeezing pressure is applied when the speed of the substrate is reduced. The regulation of squeezing pressure is performed through proportional valves 24 and 25. Feedback of the actual pressure applied by the piston-cylinder mechanism 14 for the squeeze rollers 12 is sensed by an electro-pneumatic transducer 26. The speed of the substrate is sensed by the tachometer 13 and is conducted through a transmitter 27 and combined with the signal from the feedback transducer 26 in the microprocessor 23.

According to the preferred embodiment of the present invention, the signal from the size level sensing transducer 22 is transmitted to the microprocessor 23 where it is compared with the signal from the transmitter 27 to provide a comparison between the volume of the side being consumed and the speed of the substrate. Upon the value of this comparison varying above or below a predetermined value, the squeezing pressure is further regulated through the piston-cylinder mechanism 14 and 16 in addition to the primary regulation as a function of the speed of the substrate.

It will therefore be readily understood by those persons skilled in the art that the present invention is susceptible of a broad utility and application. Many embodiments and adaptations of the present nvention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosre is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for controlling the amount of size applied to a traveling textile substrate in a size applicator in which the substrate is passed through a size bath and squeeze rollers, the squeezing pressure of which is regulated as a function of the speed of the substrate, said method further comprising sensing the volume of size being consumed and further regulating said squeezing pressure of said squeeze rollers as a function of said sensed volume of size being consumed.

2. A method for controlling the amount of size applied to a traveling textile substrate according to claim 1 and characterized further by comparing said sensed volume of size being consumed with the speed of the substrate and performing said further regulating of said squeezing pressure upon variance of the comparison from a predetermined tolerance.

* * * * *